US007631401B2

(12) United States Patent
Chen

(10) Patent No.: US 7,631,401 B2
(45) Date of Patent: Dec. 15, 2009

(54) BUCKLE STRUCTURE OF WAIST BELT

(76) Inventor: Sheng-Yi Chen, 188, Sec. 1, Pingdung Rd., Ping Chen, Taoyuan Hsien (TW)

( * ) Notice: Subject to any disclaimer, the term of this patent is extended or adjusted under 35 U.S.C. 154(b) by 392 days.

(21) Appl. No.: 11/646,069

(22) Filed: Dec. 28, 2006

(65) Prior Publication Data

US 2008/0155793 A1 Jul. 3, 2008

(51) Int. Cl.
*A44B 11/06* (2006.01)
*A44B 11/10* (2006.01)

(52) U.S. Cl. ..... 24/194; 24/196; 24/171

(58) Field of Classification Search ..... 24/171, 24/181, 194, 196, 184
See application file for complete search history.

(56) References Cited

U.S. PATENT DOCUMENTS 1,350,076 A * 8/1920 Lewis ..... 24/194
3,274,656 A * 9/1966 Hamann ..... 24/196
3,332,120 A * 7/1967 Pigiel ..... 24/171
3,879,810 A * 4/1975 Prete et al. ..... 24/194

* cited by examiner

*Primary Examiner*—Robert J Sandy
(74) *Attorney, Agent, or Firm*—Rosenberg, Klein & Lee

(57) ABSTRACT

A buckle structure includes a housing including a top plate and two side plates, a sliding wedge and a pivotal piece. Each side plate has a guiding slot. The sliding wedge is positioned below the housing and has projection portions projecting from its two sides. The projection portions are fit into corresponding guiding slots of the housing, and stoppers are positioned on top surface of the sliding wedge. The waist belt is fastened by the stoppers positioned on top surface of the sliding wedge so that the waist belt will not be loosed. Connection portions are extending from the top plate, and each connection portion has a through hole at its midpoint. Pivotal pins are extending from the pivotal piece and correspond to the through holes of the two connection portions. The pivotal piece is formed with the two pivotal pins so structure is simplified and cost is lowered.

9 Claims, 9 Drawing Sheets

BUCKLE STRUCTURE OF WAIST BELT

BACKGROUND OF THE INVENTION

1. Field of the Invention

The present invention relates to a buckle structure of a waist belt, and in particular, to a buckle structure that is easily fastened by user.

2. Description of Related Art

Buckle structures of conventional waist belts are classified into two types. One type of buckle structure includes a tongue or nipple, and a plurality of belt holes are formed on the waist belt by punching beforehand. The belt holes are used to receive the tongue or nipple. However, disadvantage of this type of the buckle structure cannot be customized to any users with different waistlines. So, more belt holes may be needed or the waist belt may be manually cut. In addition, if users gain weight or lose weight, then more belt holes may be needed or the waist belt may be manually cut again. Even worse, the tongue or nipple of the buckle structure is fitted into the belt holes repeatedly so the belt holes are worn out. Cracks are formed around periphery of the belt holes or size of the belt holes is enlarged. Thus, the tongue or nipple is easily loosed away from the belt holes so the waist belt cannot be securely fastened and user needs a new waist belt.

Another type of buckle structure has an attachment end including a ratchet teeth plate (fixing plate) for clamp one end of the waist belt. A fit-in portion is formed at the other end of the buckle structure and has a movable stopper. If the movable stopper is moved in a direction and engages with the ratchet teeth on inner surface of the waist belt, the waist belt is securely fastened. If the movable stopper is moved in a reverse direction and disengages with the ratchet teeth on inner surface of the waist belt, the waist belt is loosed. The position where the movable stopper engages with the waist belt can be changed so that the length of the waist belt is fastened will be adjusted. However, not each user is satisfied with improvement of this type of the buckle structure although this type of the buckle structure is significantly improved compared to the buckle structure with the tongue or nipple. Even worse, the ratchet teeth on inner surface of the waist belt corresponding to the movable stopper should be formed beforehand and process steps and process time of the buckle structure are increased. After the ratchet teeth engage with the movable stopper repeatedly, the ratchet teeth are prone to be worn out and engagement between the ratchet teeth and the movable stopper is not as tight as before.

Thus, there is a need for a buckle structure of waist belt.

SUMMARY OF THE INVENTION

It is the main object of the present invention to provide a buckle structure of a waist belt which decrease working process, shorten working time and fasten more securely.

It is the second object of the present invention to provide a buckle structure of a waist belt which has simple structure, save time of assembly and has lower cost.

It is the third object of the present invention to provide a buckle structure of a waist belt which is convenient to fasten.

It is the forth object of the present invention to provide a buckle structure of a waist belt which is convenient to adjust length of the waist belt.

To achieve the object of a buckle structure of a waist belt, the buckle structure of the present invention includes a housing and a sliding wedge. The housing includes a top plate and two side plates. Each of the two side plates has a guiding slot which is slant. The sliding wedge is positioned below the housing and has a pair of projection portions protruding from its two sides. The projection portions of the sliding wedge are adapted to be fit into corresponding guiding slots of the housing, and a plurality of stoppers are positioned on top surface of the sliding wedge.

Advantage of the present invention is in the following. The sliding wedge is fitted into the guiding slots so that the waist belt is securely fastened by a plurality of stoppers positioned on top surface of the sliding wedge. In this light, the waist belt will not be easily loosed and ratchet teeth need not be formed on the inner surface of the waist belt so that time of manufacturing is significantly shortened.

Furthermore, two connection portions are downwardly extending from the top plate, and each of the two connection portions is positioned at rear of the top plate. Each of the two connection portions has a through hole at its midpoint. The buckle structure also includes a pivotal piece which is positioned on the bottom of the housing and rear of the side plates. A pair of pivotal pins is extending from the both sides of the pivotal pieces, and the pivotal pins corresponds the through holes of the two connection portions. Two pivotal pins are respectively inserted into the through holes of the two connection portions. The pivotal piece is integrally formed with the two pivotal pins so structure of the teeth is simplified and manufactured by a mold. Then, cost of the teeth is lowered and time of assembly is saved.

Each of the two connection portions has a recess at its rear end, and the through hole is in communication with the recess so two pivotal pins are inserted into the through holes of the two connection portions by the recesses. It is convenient to assemble the buckle structure.

Two grooves are respectively formed on two sides of the sliding wedge, and the sliding wedge movably meshes with the belt adjustment unit. The belt adjustment unit is inserted into the two guiding slots and meshes with the two grooves of the sliding wedge. Two hand-push portions of the belt adjustment unit are extending out of the guiding slots, and user needs to press and move the two hand-push portions so that the belt adjustment unit slides along the guiding slots and the length of the belt is adjusted.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

Figure 1:
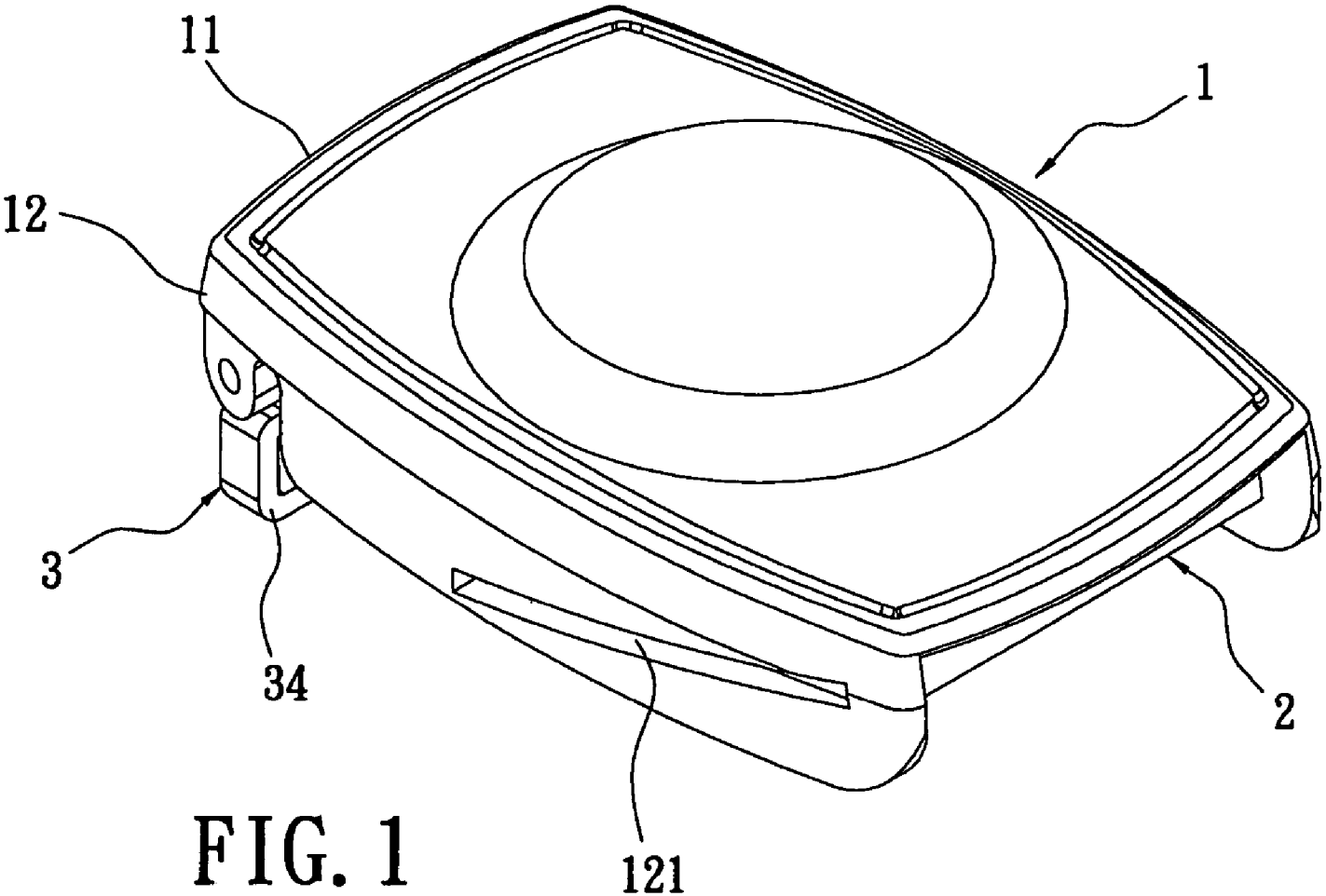
FIG. 1 is a perspective view of a buckle structure of the first embodiment according to the present invention.
Figure 2:
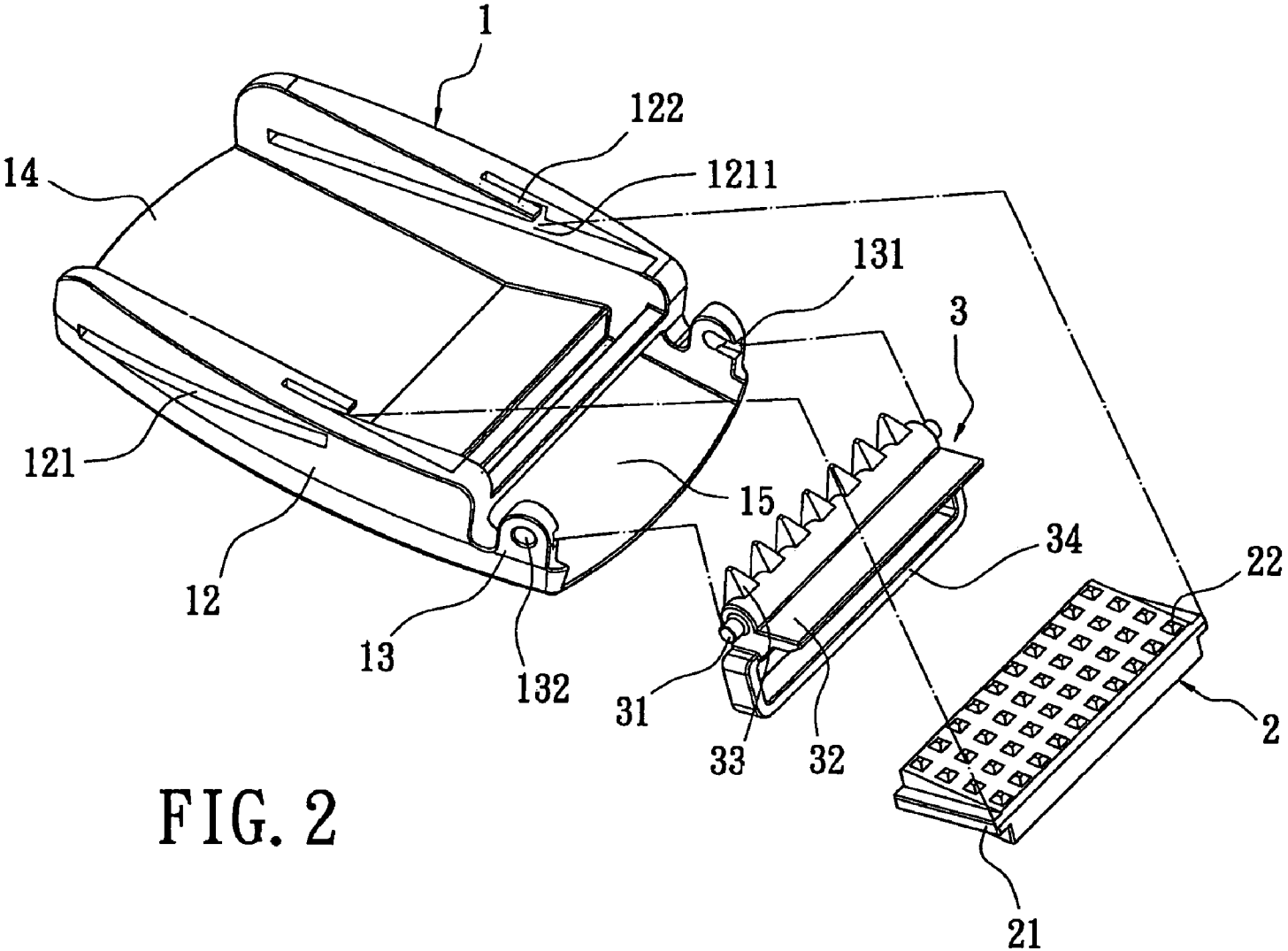
FIG. 2 is an exploded view of a buckle structure of the first embodiment according to the present invention.

Referring to FIGS. 1 and 2, they illustrate a buckle structure of a waist belt according to the first embodiment of the present invention. The buckle structure includes a housing 1, a sliding wedge 2 and a pivotal piece 3. The housing 1 includes a top plate 11 and two side plates 12. Each of the two side plates 12 has a guiding slot 121 which is slant. The sliding wedge 2 is positioned at the bottom of the housing 1 and has a pair of projection portions 21 protruding from its two sides and corresponding to the guiding slots 121. Each of the guiding slots 121 has an opening 1211, and the sliding wedge 2 slides along the guiding slots 121 through the opening 1211 and the projection portions 21 are inserted into the guiding slots 121.

A plurality of stoppers 22 is positioned on top surface of the sliding wedge 2, and each of the side plates 12 has a stopper pin 122 at its bottom. The stopper pins 122 are respectively positioned below the openings 1211 so that the sliding wedge 2 will not be loosed away along the openings 1211.

Two connection portions 13 are downwardly extending from the top plate 11, and each of the two connection portions 13 is positioned at rear of the side plate 12. Each of the two connection portions 13 has a recess 131 at its rear end, and the recesses 131 are extending forwardly to middle of the two connection portions 13. Each of the two connection portions 13 has a through hole 132 at its midpoint so that the through holes 132 are in communication with the recesses 131.

A receiving end 14 is integrally formed with one end of the housing 1, and a fixing end 15 is integrally formed with the other end of the housing 1. The receiving end 14 is positioned below of the housing 1 and front of the side plates 12. And, the fixing end 15 is positioned below of the housing 1 and rear of the side plates 12, and the pivotal piece 3 are positioned at the fixing end 15. Two pivotal pins 31 are respectively extending from both ends of the pivotal piece 3 and correspond to two through holes 132 of the connection portions 13. The two through holes 132 are respectively used to receive the two pivotal pins 31 of the pivotal piece 3. A fixing plate 32 is extending from the front end of the pivotal piece 3, and a plurality of teeth 33 are separately positioned on the top of the pivotal piece 3. A frame 34 is connected with the bottom surface of the pivotal piece 3.

Figure 3:
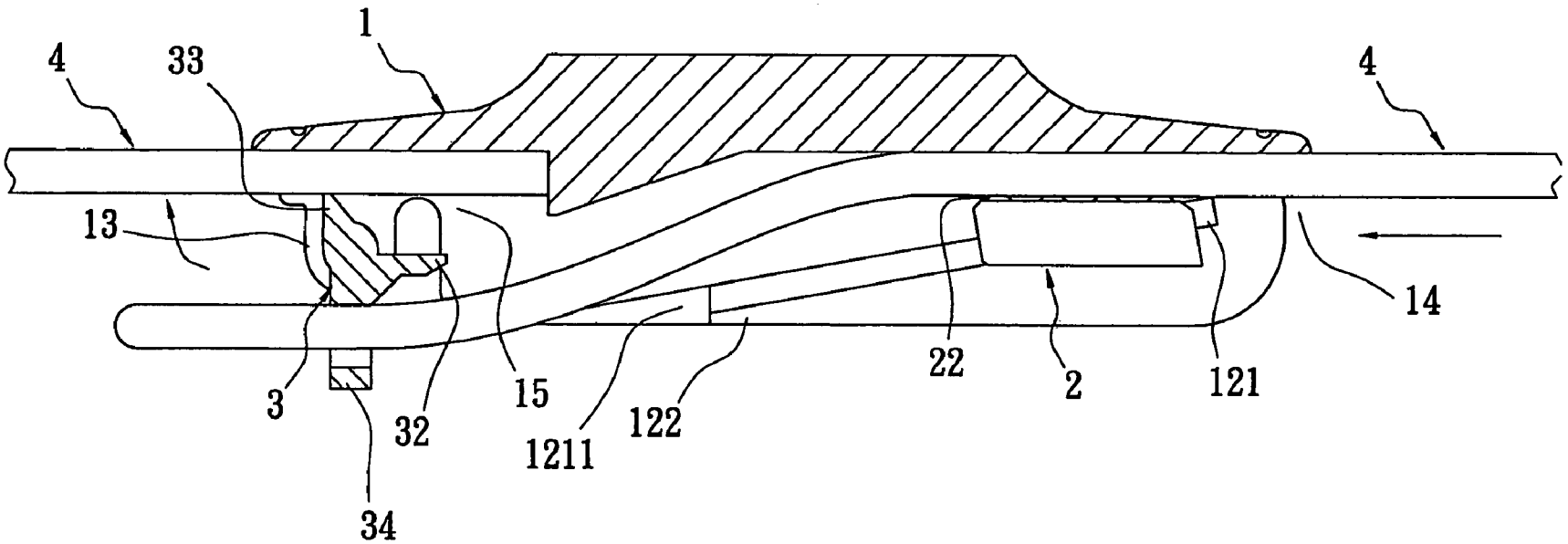
FIG. 3 is a side view showing how the buckle structure of the first embodiment is fastened according to the present invention.
Figure 4:
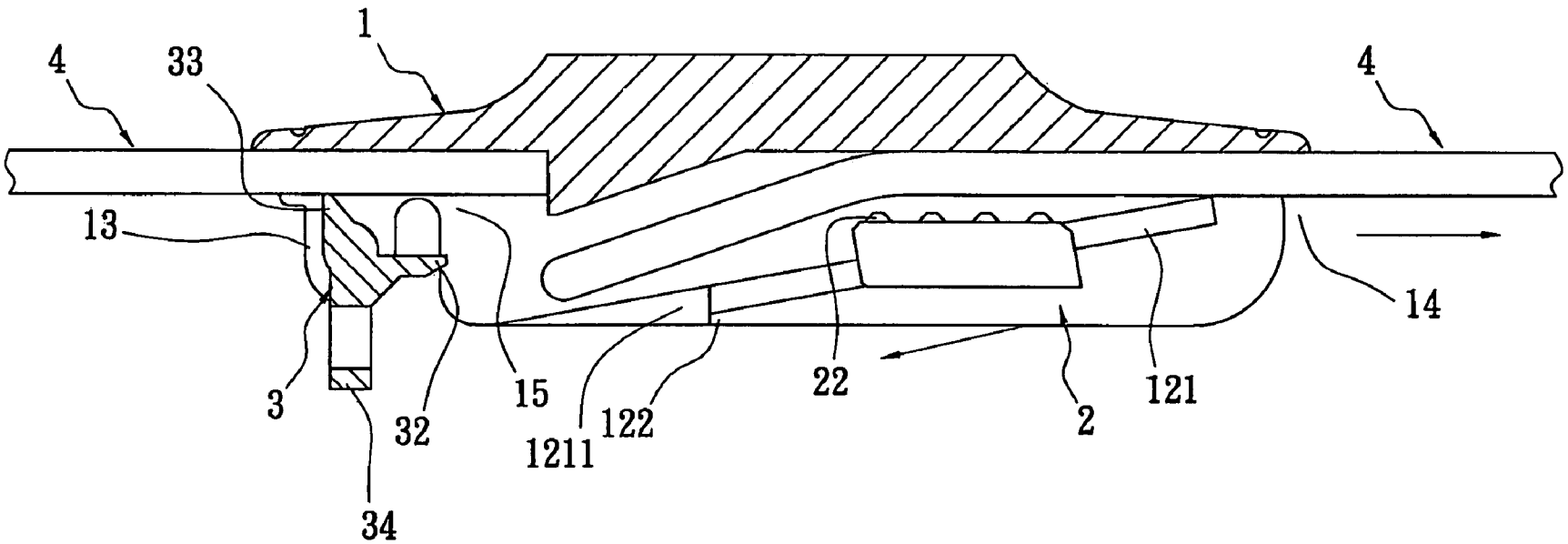
FIG. 4 is a side view showing how the buckle structure of the first embodiment is loosed according to the present invention.

Referring to FIGS. 3 and 4, the pivotal piece 3 is used to clamp a waist belt 4. When the pivotal piece 3 is rotated, one end of the waist belt 4 is clamped by the fixing plate 32 and the teeth 33, so the end of the waist belt 4 is clamped by the pivotal piece 3, and the other end of the waist belt 4 is inserted into the receiving end 14 of the housing 1, abuts the stoppers 22 of the sliding wedge 2, and passes through the frame 34 of the pivotal piece 3. When the bottom of the sliding wedge 2 abuts and is manually moved along the guiding slots 121, length of waist belt can be adjusted. Then, one end inserted into the receiving end 14 of the housing 1 is manually pushed toward the fixing end 15, and the bottom of the sliding wedge 2 is manually pushed and the sliding wedge 2 is moved toward the receiving end 14 so that the waist belt 4 is securely fastened. If the waist belt 4 could be loosed, then the sliding wedge 2 is moved toward the openings 1211 of the guiding slots 121. In addition, one end of the waist belt 4 is pulled toward the receiving end 14.

Figure 5:
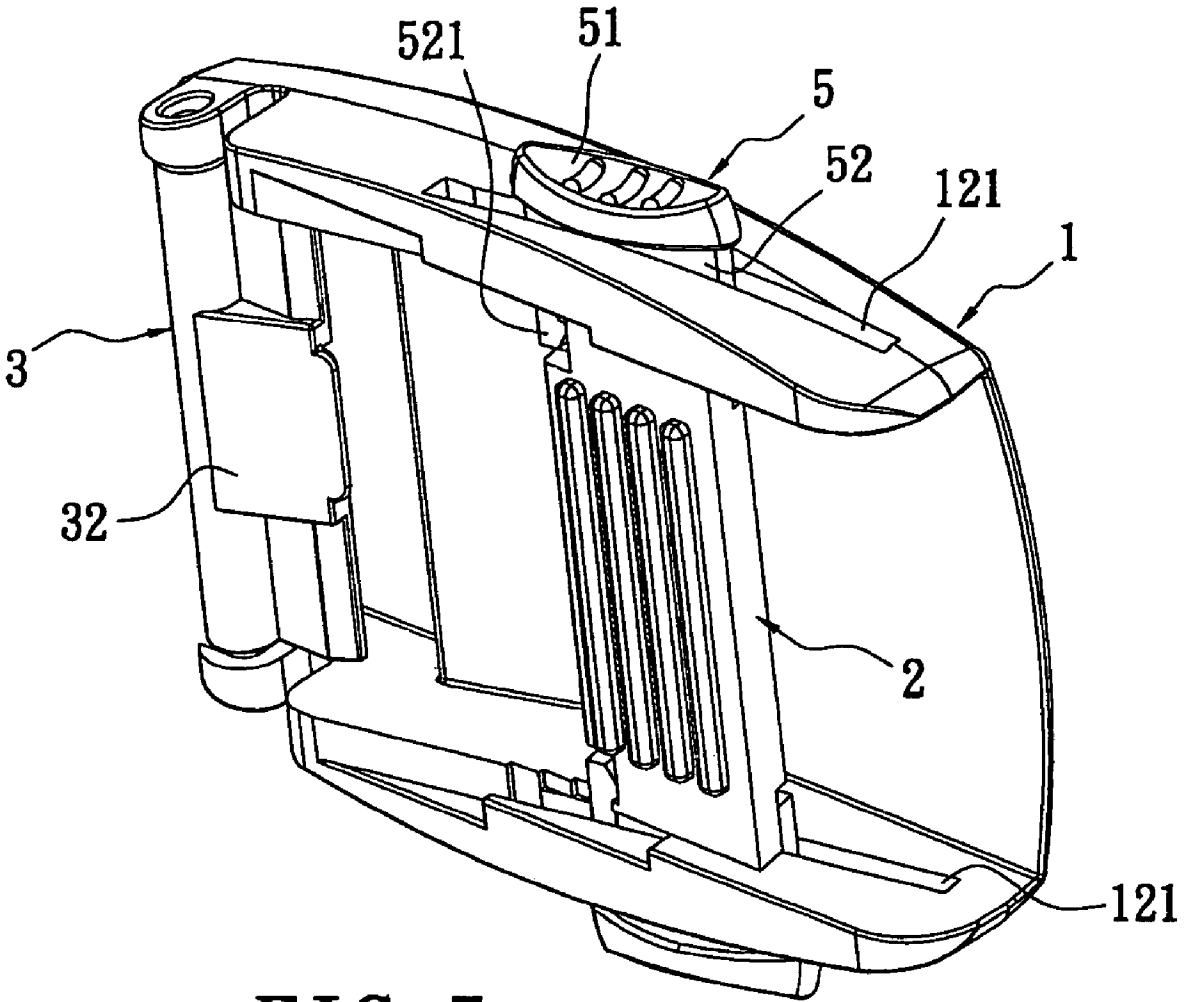
FIG. 5 is a perspective view of a buckle structure of the second embodiment according to the present invention.
Figure 6:
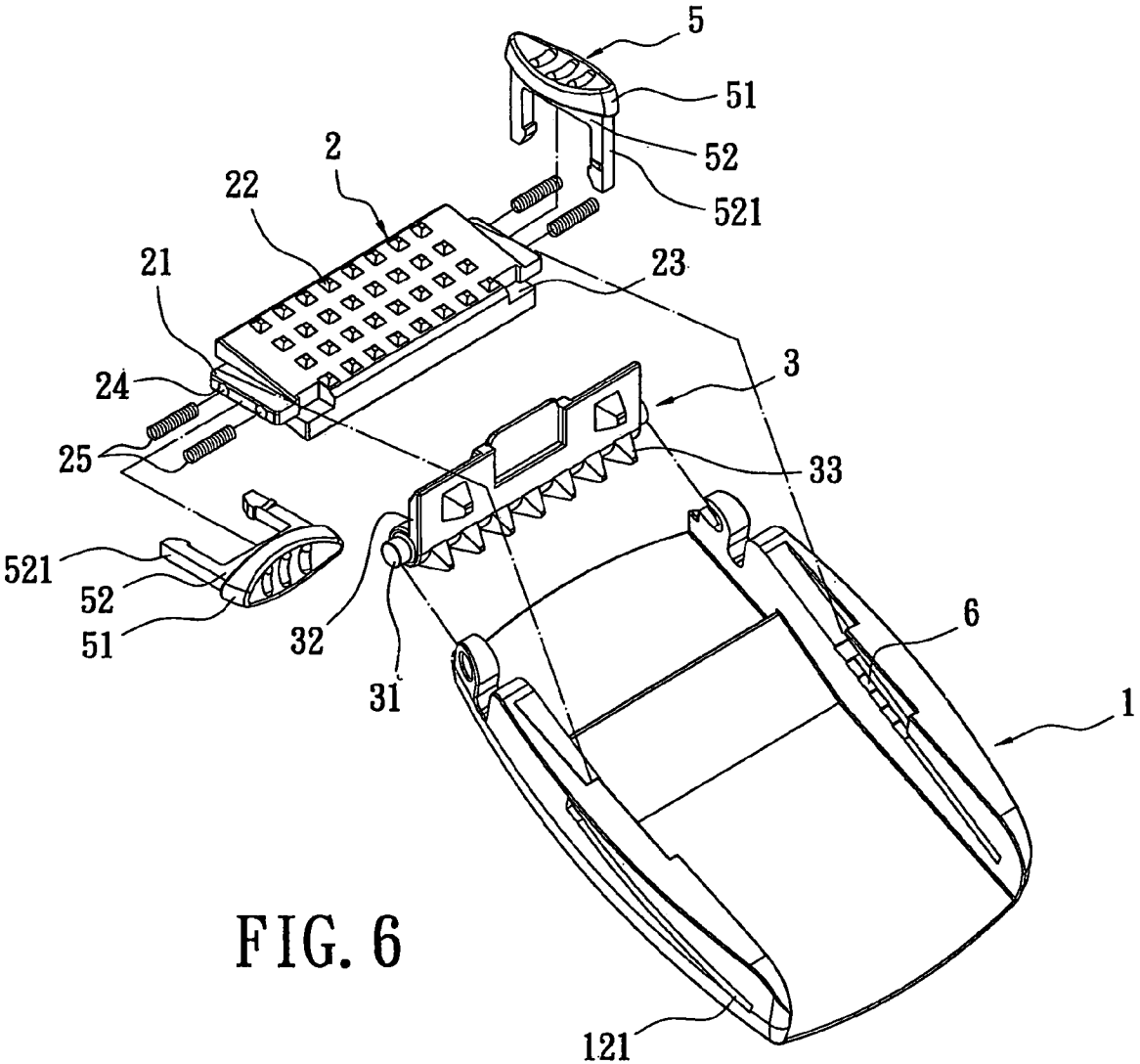
FIG. 6 is an exploded view of a buckle structure of the second embodiment according to the present invention.

Referring to FIGS. 5 and 6, the second embodiment of the present invention is shown. Two grooves 23 are respectively positioned at the two side of the sliding wedge 2. One of the grooves 23 is in vicinity of the top of the sliding wedge 2 and front of the projection portions 21, and the other of the groove 23 is in vicinity of the bottom of the sliding wedge 2 and rear of the projection portions 21. Two holes 24 are respectively formed on the projection portions 21, and each of the holes 24 is used to receive one resilient element 25. One ends of the resilient elements 25 protrude out of the holes 24.

The sliding wedge 2 movably meshes with a belt adjustment unit 5. The belt adjustment unit 5 includes a hand-push portion 51 and a snap hook 52. The hand-push portion 51 has a concave top surface and ergonomic so that it is convenient for user to push. The bottom of the hand-push portion 51 is integrally formed with the snap hook 52 so that the resilient elements 25 protruding out of the holes 24 abut against the snap hook 52. Two hook extensions 521 are integrally formed with two sides of the snap hook 52 and respectively inserted into the guiding slots 121 and received at the recesses 23. The hand-push portions 51 respectively protrudes out of the guiding slots 121, and there is clearness between the hand-push portions 51 and the top plates 12.

Each of the guiding slots 121 has a plurality of stoppers 6 which are positioned between the openings 1211 of the guiding slots 121 and middle of the guiding slots 121. In addition, the stoppers 6 are step-liked. When the sliding wedge 2 abuts the stoppers 6, the sliding wedge 2 is prevented from loosing away from the guiding slots 121 by the stoppers 6.

Figure 7:
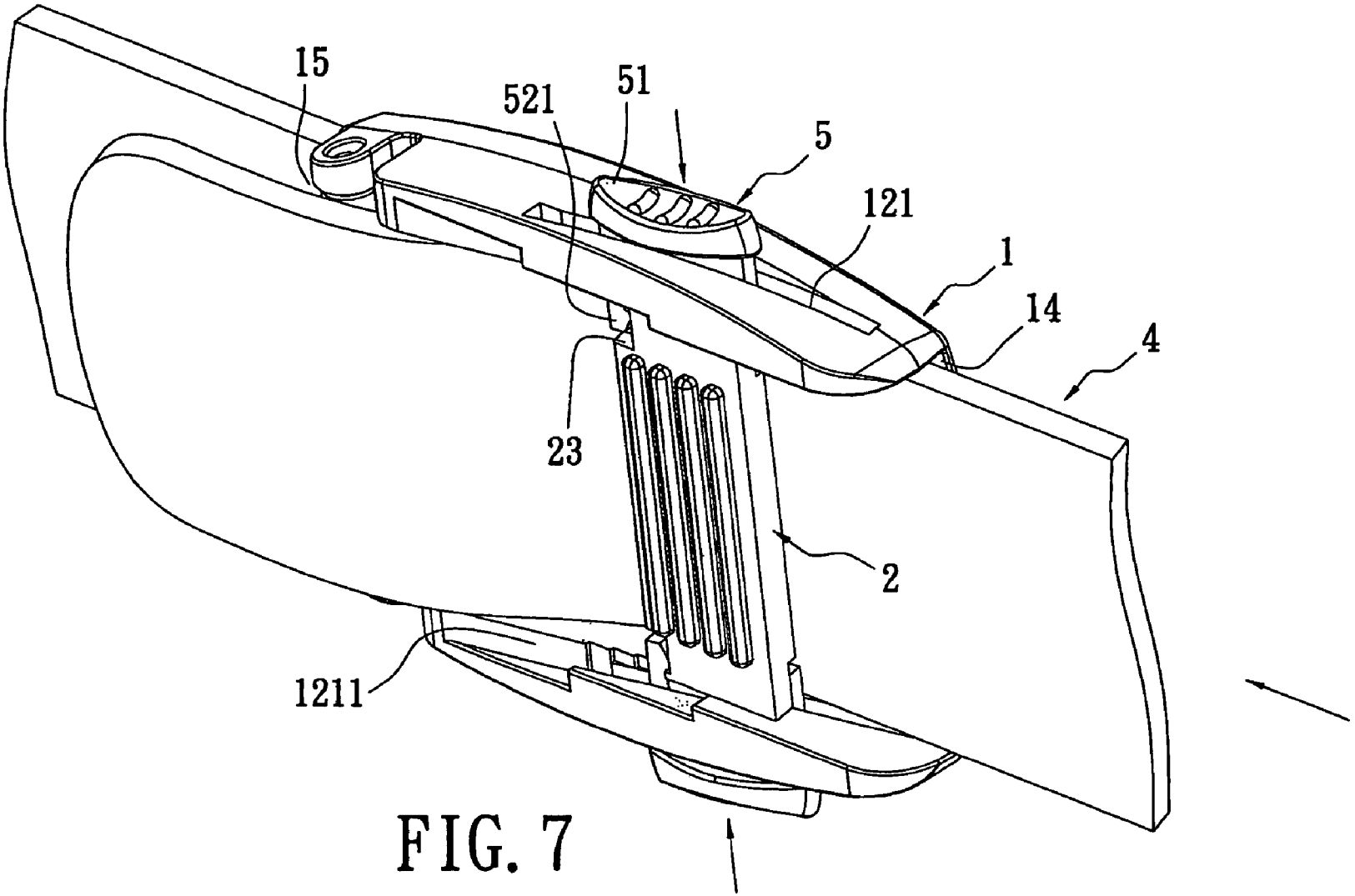
FIG. 7 is a side view showing how the buckle structure of the second embodiment is fastened according to the present invention.
Figure 8:
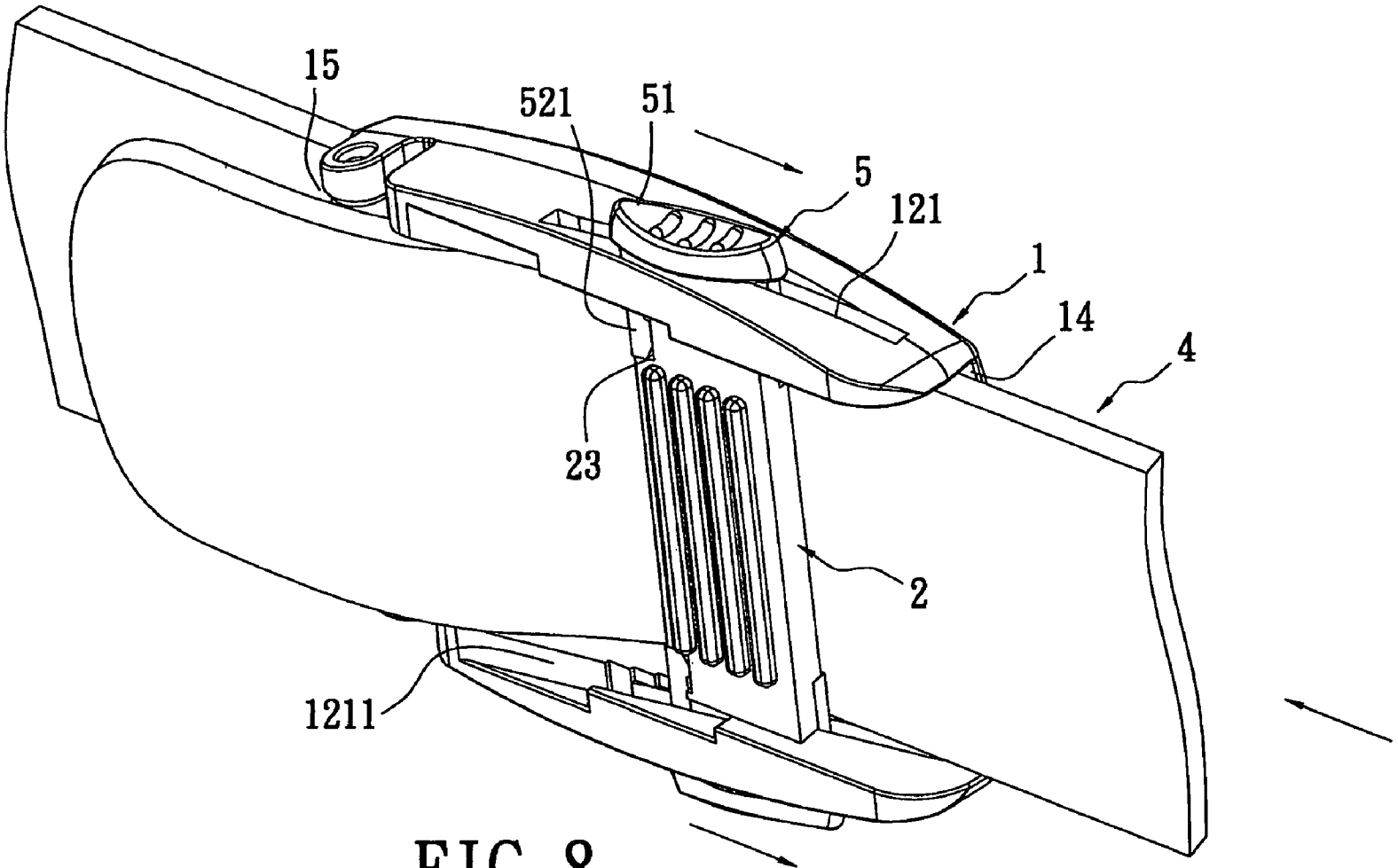
FIG. 8 is another side view showing how the buckle structure of the second embodiment is fastened according to the present invention.

Referring to FIGS. 7 and 8, one end of the waist belt 4 is clamped by the pivotal piece 3 (as shown in FIG. 6). In the second embodiment, the frame 34 is deleted from the pivotal piece 3, and a plurality of teeth 33 are separately positioned on the top of the pivotal piece 3 and the fixing plate 32 (as shown in FIG. 6). The hand-push portion 51 are pushed at the same time. The belt adjustment units 5 is biased against by the resilient elements 25 so that two hook extensions 521 move along the grooves 23 and abut the bottom of the grooves 23. Then, the sliding wedge 2 slides along the guiding slots 121 so the length of the waist belt 4 is adjusted. The hand-push portions 51 are manually pressed so that the sliding wedge 2 moves toward the receiving end 14 of the housing 1. Meanwhile, the other end of the waist belt 4 is manually inserted into the receiving end 41 of the housing 1 and in contact with the stoppers 22 of the sliding wedge 2. Because the other end of the waist belt 4 moves toward the fixing end 15, the length of the waist belt 4 is getting shorter and shorter. If the hand-push portion 51 is not manually pressed and pushed any more, the sliding wedge 2 doesn't move and the waist belt 4 is fastened.

Figure 9:
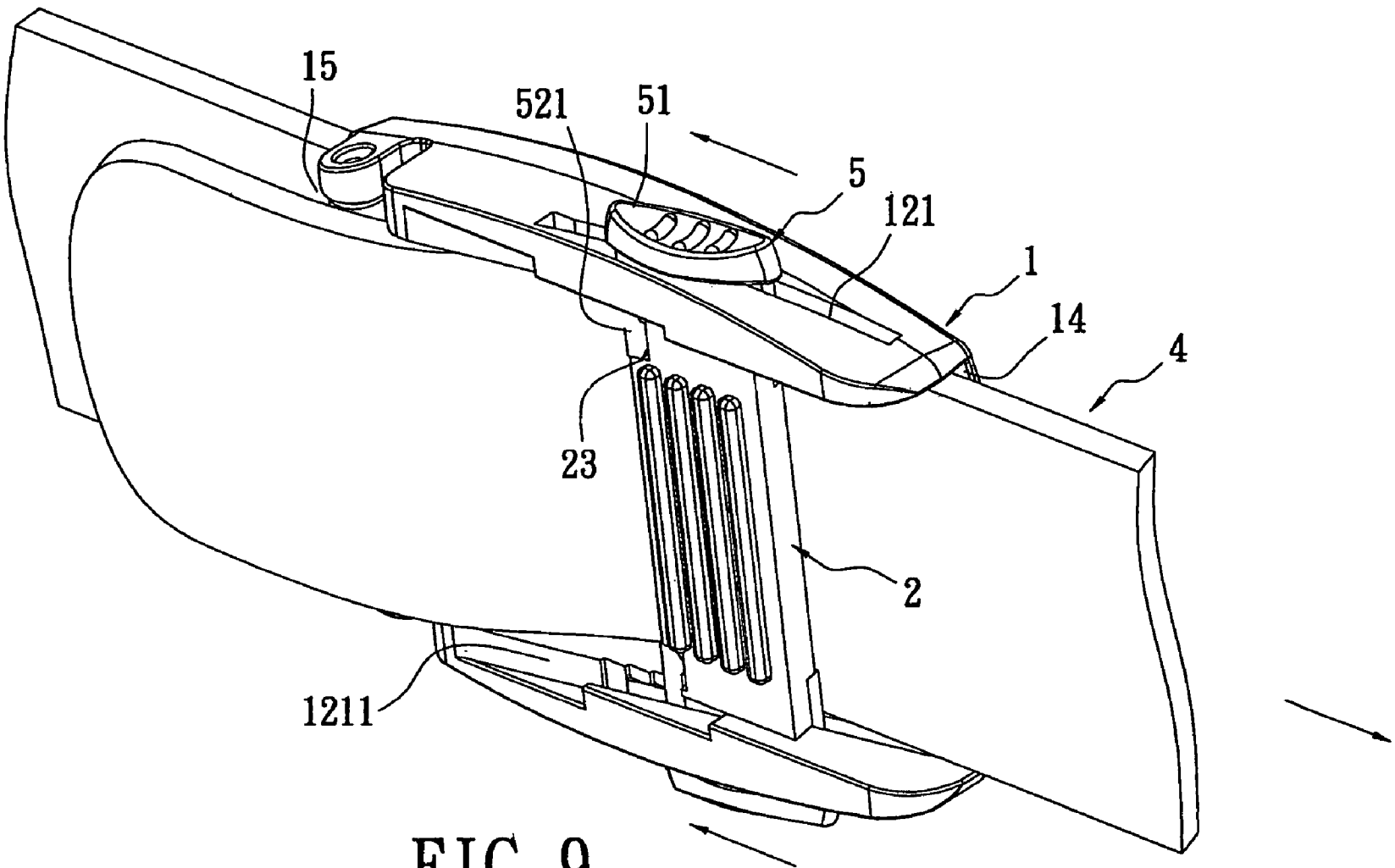
FIG. 9 is a side view showing how the buckle structure of the second embodiment is loosed according to the present invention.

Referring to FIG. 9, when the waist belt 4 is loosed, the hand-push portion 51 must be manually pressed and the sliding wedge 2 is moved toward the openings 1211 of the guiding slots 121. Meanwhile, the other end of the waist belt 4 is manually pulled toward the receiving end 41 of the housing 1 so the waist belt 4 is loosed.

Advantages of the present invention can be summarized as in the following:

1. When the sliding wedge 2 is inserted into the guiding slots 121, the waist belt 4 will be securely fastened because there is a plurality of the stoppers 22 on the top of the sliding wedge 2. Without forming the ratchet teeth on inner surface of the waist belt 4, it saves time for manufacturing the waist belt 4.

2. The pivotal piece 3 is integrally formed with the two pivotal pins 31 so that structure of the pivotal piece 3 is simplified and manufactured by a mold. Then, cost of the pivotal piece 3 is lowered and time of assembly is saved.

3. Each of the two connection portions 13 has a recess 131 at its rear end and has a through hole 132 at its midpoint so that the through holes 132 are in communication with the recesses 131. The two pivotal pins 311 are inserted into the through holes 132 through the recesses 131. It is convenient to assemble the buckle structure.

4. Two sides of the sliding wedge 2 are respectively connected with two belt adjustment units 5. When the hand-push portions 51 of the belt adjustment units 5 are manually pressed, the sliding wedge 2 moves along the guiding slots 121 and the length of the waist belt 4 is adjusted. When the hand-push portions 51 of the belt adjustment units 5 are released, the shielding wedge 2 cannot move along the guiding slot 121 and the waist belt 4 is securely fastened.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A buckle structure for a waist belt, comprising:

a housing, including a top plate and two side plates, and each of the two side plates has a guiding slot which is slant; and a sliding wedge, positioned below a portion of the housing and having a pair of projection portions protruding from its two sides, and the projection portions respectively adapted to be fit into the corresponding guiding slots of the housing and a plurality of stoppers positioned on its top surface;

wherein each of the guiding slots has an opening, and the sliding wedge is inserted into guiding slots through the openings; and, wherein each of the side plates has a stopper pin at its bottom, and the stopper pins are respectively positioned below the openings.

2. A buckle structure for a waist belt, comprising:

a housing, including a top plate and two side plates, and each of the two side plates has a guiding slot which is slant; and a sliding wedge, positioned below a portion of the housing and having a pair of projection portions protruding from its two sides, and the projection portions respectively adapted to be fit into the corresponding guiding slots of the housing and a plurality of stoppers positioned on its top surface;

wherein two connection portions are downwardly extending from the top plate, and each of the two connection portions is positioned at rear of the top plate and has a through hole at its midpoint and a recess at its rear end, and the through holes are in communication with the recesses because the recesses extend forwardly to middle of the two connection portions.

3. The buckle structure as claimed in claim 2, further comprising a pivotal piece, and wherein a receiving end is formed with one end of the housing and a fixing end is formed with the other end of the housing, and the pivotal piece is positioned at the fixing end and used to clamp one end of the waist belt.

4. The buckle structure as claimed in claim 3, wherein the pivotal piece is used to clamp one end of the waist belt, and two pivotal pins respectively extend from two ends of the pivotal piece and correspond to the through holes of the connection portions so that the two pivotal pins is respectively inserted into the through holes of the connection portions.

5. The buckle structure as claimed in claim 4, wherein a fixing plate is extending from the front end of the pivotal piece, and a plurality of teeth are separately positioned on the top of the pivotal piece and the fixing plate so that one end of the waist belt is clamped by the fixing plate and the teeth and the other end of the waist belt is inserted into the receiving end.

6. The buckle structure as claimed in claim 4, wherein the fixing plate is extending from the front end of the pivotal piece, and a frame is connected with the bottom surface of the pivotal piece, and the a plurality of teeth are separately positioned on the top of the pivotal piece, and one end of the waist belt is clamped by the fixing plate and the teeth, and the other end of the waist belt is inserted into the receiving end and passes through the frame.

7. A buckle structure for a waist belt, comprising:

a housing, including a top plate and two side plates, and each of the two side plates has a guiding slot which is slant; and a sliding wedge, positioned below a portion of the housing and having a pair of projection portions protruding from its two sides, and the projection portions respectively adapted to be fit into the corresponding guiding slots of the housing and a plurality of stoppers positioned on its top surface;

wherein the sliding wedge has two grooves at its two sides, and a plurality of holes are respectively formed on the projection portions and each of the holes is used to receive one resilient element, and one end of the resilient element protrudes out of the hole and the sliding wedge movably meshes with a belt adjustment unit, and a pair of the belt adjustment units are respectively inserted into the two guiding slots and respectively mesh with the two grooves of the sliding wedge so that the belt adjustment units abut against the resilient elements protruding out of the holes.

8. The buckle structure as claimed in claim 7, wherein the belt adjustment unit includes a hand-push portion and a snap hook, and the hand-push portion has a concave top surface and the bottom of the hand-push portion is formed with the snap hook, the snap hook abuts against the one end of resilient elements, and two hook extensions are integrally formed with two sides of the snap hook and respectively inserted into the guiding slots, and received at the grooves so that the hand-push portions respectively protrudes out of the guiding slots and there is clearness between the hand-push portions and the side plates.

9. A buckle structure for a waist belt, comprising:

a housing, including a top plate and two side plates, and each of the two side plates has a guiding slot which is slant; and a sliding wedge, positioned below a portion of the housing and having a pair of projection portions protruding from its two sides, and the projection portions respectively adapted to be fit into the corresponding guiding slots of the housing and a plurality of stoppers positioned on its top surface;

wherein each of the guiding slots has an opening and has a plurality of stoppers positioned between the openings of the guiding slots and middle of the guiding slots, and the stoppers are disposed in step-like manner and the sliding wedge abuts the stoppers.

* * * * *